US005296895A

United States Patent [19]

Naito

[11] Patent Number: 5,296,895

[45] Date of Patent: Mar. 22, 1994

[54] IMAGE FORMING APPARATUS WITH TONER DETECTION

[75] Inventor: Yoshikazu Naito, Gamagori, Japan

[73] Assignee: Minolta Camera Kabushiki Kaisha, Osaka, Japan

[21] Appl. No.: 775,337

[22] Filed: Oct. 11, 1991

[30] Foreign Application Priority Data

Oct. 12, 1990 [JP] Japan ..... 2-274476

[51] Int. Cl.[5] ..... G03G 21/00

[52] U.S. Cl. ..... 355/208; 346/160; 355/211

[58] Field of Search ..... 355/203, 204, 208, 210, 355/211, 214, 245, 246, 261, 265; 346/153.1, 160, 108

[56] References Cited

U.S. PATENT DOCUMENTS

| | | | |
|---|---|---|---|
| 4,313,671 | 2/1982 | Kuru | 355/214 |
| 4,617,245 | 10/1986 | Tanaka et al. | 430/58 |
| 4,735,908 | 4/1988 | Higashi et al. | 357/30 X |
| 4,796,065 | 1/1989 | Kanbayashi | 355/208 |
| 4,910,557 | 3/1990 | Imai | 355/246 |
| 4,950,905 | 8/1990 | Butler et al. | 355/246 X |
| 4,984,022 | 1/1991 | Matsushita et al. | 355/246 |

*Primary Examiner*—A. T. Grimley
*Assistant Examiner*—Sandra L. Brasé

[57] ABSTRACT

An electrophotographic image forming apparatus which comprises a photoreceptor medium including a substrate and a photosensitive layer formed on the substrate, and a photo-electric toner sensor assembly for measuring the amount of rays of light undergoing a diffuse reflection from the photoreceptor medium. The substrate has a regularly developed pattern of grooves formed thereon. The photoelectric toner sensor assembly comprises a light emitting element for projecting the rays of light onto the photoreceptor medium so as to reflect therefrom and a light receiving element for detecting the rays of light undergoing the diffuse reflection. The light emitting and receiving elements are so positioned that a common plane containing respective optical axes of those light emitting and receiving elements can lie substantially parallel to any one of the grooves on the substrate.

7 Claims, 4 Drawing Sheets

IMAGE FORMING APPARATUS WITH TONER DETECTION

BACKGROUND OF THE INVENTION

1. Field of the Invention

The present invention generally relates to an electrophotographic image forming apparatus utilizing a xerographic process and, more specifically, to a toner measuring mechanism used in the electrophotographic image forming apparatus for measuring the quantity of toner deposited on an electrostatic latent image carrier.

2. Description of the Related Art

In an electrophotographic image forming apparatus utilizing the Carson or xerographic process such as, for example, an electrophotographic copying machine or a laser printer, a toner measuring mechanism comprising a photoelectric toner sensor assembly is generally utilized to measure the quantity of toner supplied onto a photosensitive medium such as a photoreceptor drum on a trial basis. Any indication of the quantity of toner deposit provided by the photoelectric toner sensor assembly is subsequently utilized to effect various controls necessary to stabilize the density of toner used during an actual development, the bias voltage applied during the actual development, the voltage applied to electrostatic chargers, the intensity of light used during the actual development and so on for eventually accomplishing a favorable image reproduction.

An example of the photoelectric toner sensor assembly used for that purpose and operable with a color toner is generally identified by 100 in FIG. 6. The photoelectric toner sensor assembly 100 comprises a light emitting diode (LED) 101 and a light receiving element or photodiode 102 arranged in a side-by-side fashion with each other and spaced a distance outwardly from a photosensitive surface of the photoreceptor drum 110. Specifically, the light receiving element 102 is so positioned relative to the light emitting diode 101 as to receive a diffused component of rays of light from the light emitting diode 101 which has undergone a diffuse reflection from a layer of color toner deposited on the photosensitive surface of the photoreceptor drum 110. The light emitting and receiving elements 101 and 102 have their own optical axes lying on a common plane and are so positioned that the common plane containing the respective optical axes of the light emitting and receiving elements 101 and 102 can either coincide with or lie parallel to a plane containing the axis of rotation of the photoreceptor drum 110.

As is well known to those skilled in the art, the rays of light projected from the light emitting diode 101 and subsequently reflected by the toner deposit on the photoreceptor drum contain a specular reflecting component which undergoes a specular reflection and a diffused reflecting component which undergoes a diffuse reflection. On the other hand, when it comes to the use of the color toner in the image forming apparatus, an increase of the quantity of the color toner deposit on the photoreceptor drum will bring about little reduction in amount of the rays of light undergoing the specular reflection and will rather result in a steep gradient of increase in amount of the rays of light undergoing the diffuse reflection. In view of this, the photoelectric toner sensor assembly is of a design detecting the diffuse reflection so that an accurate indication of the quantity of the toner deposit can be obtained.

The U.S. Pat. No. 4,617,245, issued Oct. 14, 1986, discloses the use on a photoreceptor medium of a means for suppressing interference fringes known as Moire fringes resulting from interference of light which often occurs where an electrostatic latent image is formed by causing a laser beam to scan the photosensitive surface. Specifically, while the disclosed photoreceptor medium is in the form of a drum comprising an electroconductive cylinder and a photosensitive layer formed on an outer peripheral surface of the cylinder, the fringe suppressing means comprises a multiple of circumferentially extending and juxtaposed grooves formed on the outer peripheral surface of the electroconductive cylinder. Each of those grooves is described having a groove face (or "a tapered reflective surface" according to a terminology used therein) of a generally U-shape, V-shape, trapezoidal or semi-ellipsoidal shape in section while leaving a circumferentially extending ridge (or "a linear projection" according to the same) defined between each neighboring grooves. This patent also discloses that the grooves for the suppression of the interference fringes are of a depth (or "a taper height" according to the same) equal to half the wavelength of incident light used during an image exposure, preferably 100 μm or less and, more preferably, within the range of 0.3 to 30 μm, and of a width within the range of 10 to 500 μm and spaced at a pitch of 1,000 μm or less.

This patent describes that the grooves referred to above may not be always limited to those juxtaposed with each other, but may be parts corresponding to turns of a spiral groove extending about the axis of rotation of the photoreceptor drum.

During the course of development of the present invention, the inventor has found a problem occurring when, as one of the methods of arranging the photoelectric sensor assembly relative to the photoreceptor drum of a type provided with the fringe suppressing means, the photoelectric toner sensor assembly is arranged such as shown in FIG. 6. Specifically, in the system shown in FIG. 6, the employment of the fringe suppressing means is liable to increase the diffuse reflection from the outer peripheral surface of the photoreceptor drum 110. Therefore, the photoelectric toner sensor assembly 100 tends to provide an output of such a characteristic as shown in FIG. 7 wherein the voltage of the sensor output is relatively high when the quantity of toner deposited on the photosensitive layer is zero, that is, when the photosensitive layer is exposed bare. This results in a reduction in signal-to-noise ratio during the measurement of the quantity of the toner deposit, accompanied by a reduction in amount of change of the sensor output voltage. In view of the foregoing, a relatively large error tends to occur in the measurement of the quantity of the toner deposit and, therefore, it is generally considered difficult to accomplish a favorable image stabilizing control.

It is pointed out that the inventor of the present invention has no knowledge of any prior art literature which is addressed to the system wherein the photoreceptor medium of the type having the fringe suppressing means formed thereon is actually used in combination with a specific arrangement of the photoelectric toner sensor assembly such as discussed with reference to FIG. 6.

SUMMARY OF THE INVENTION

Accordingly, the present invention has been devised to provide an improved image forming apparatus wherein the quantity of toner deposited on an electrostatic latent image carrier can be optically detected substantially accurately when Moire fringes are formed on the latent image carrier.

In order to accomplish the foregoing object of the present invention, there is provided an electrophotographic image forming apparatus which comprises a photoreceptor medium including a substrate and a photosensitive layer formed on the substrate, and a measuring means for measuring the amount of rays of light reflected from the photoreceptor medium and undergoing diffuse reflection. The substrate has a regularly developed pattern of grooves formed thereon, and the measuring means comprises a light emitting element and a light receiving element, each of said elements having an optical axis. The light emitting and receiving elements are so positioned that a common plane containing the respective optical axes of those light emitting and receiving elements can lie substantially parallel to any one of the grooves on the substrate.

In the practice of the present invention, the photoreceptor medium has a longitudinal axis and may be in the form of any of a rotatably supported cylindrical drum and a generally endless belt. The grooves on the substrate may extend either parallel to or transverse to the longitudinal axis of the photoreceptor medium, that is, an axis of rotation of the photoreceptor drum or an axis of rotation of the photoreceptor belt.

Preferably, the light emitting element and the light receiving element are so positioned relative to the photoreceptor medium that the angle between the optical axis of the light emitting element and a line normal to the photoreceptor medium and the angle between the optical axis of the light receiving element and the line normal to the photoreceptor medium are within the range of 40 to 70 degrees and within the range of 0 to 10 degrees, respectively.

The grooves on the substrate may be either juxtaposed to each other or extend slantwise regardless of the shape of the photoreceptor medium. However, in either case, those grooves are preferably formed to have a maximum depth of 0.3 to 1.0 μm at a pitch of 0.1 to 0.2 mm.

According to the present invention, arrangement has been made that the common plane containing the respective optical axes of the light emitting and receiving elements lies substantially parallel to any one of the grooves on the substrate. Therefore, of the rays of light projected by the light emitting diode and subsequently reflected from the photoreceptor medium, a light component undergoing a diffuse reflection from the fringe suppressing grooves on the substrate of the photoreceptor medium will neither substantially travel towards nor be sensed by the light receiving element, and therefore, the sensor output from the light receiving element will have an increased signal-to-noise ratio. This can result in a facilitation of a favorable image stabilizing control.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1:
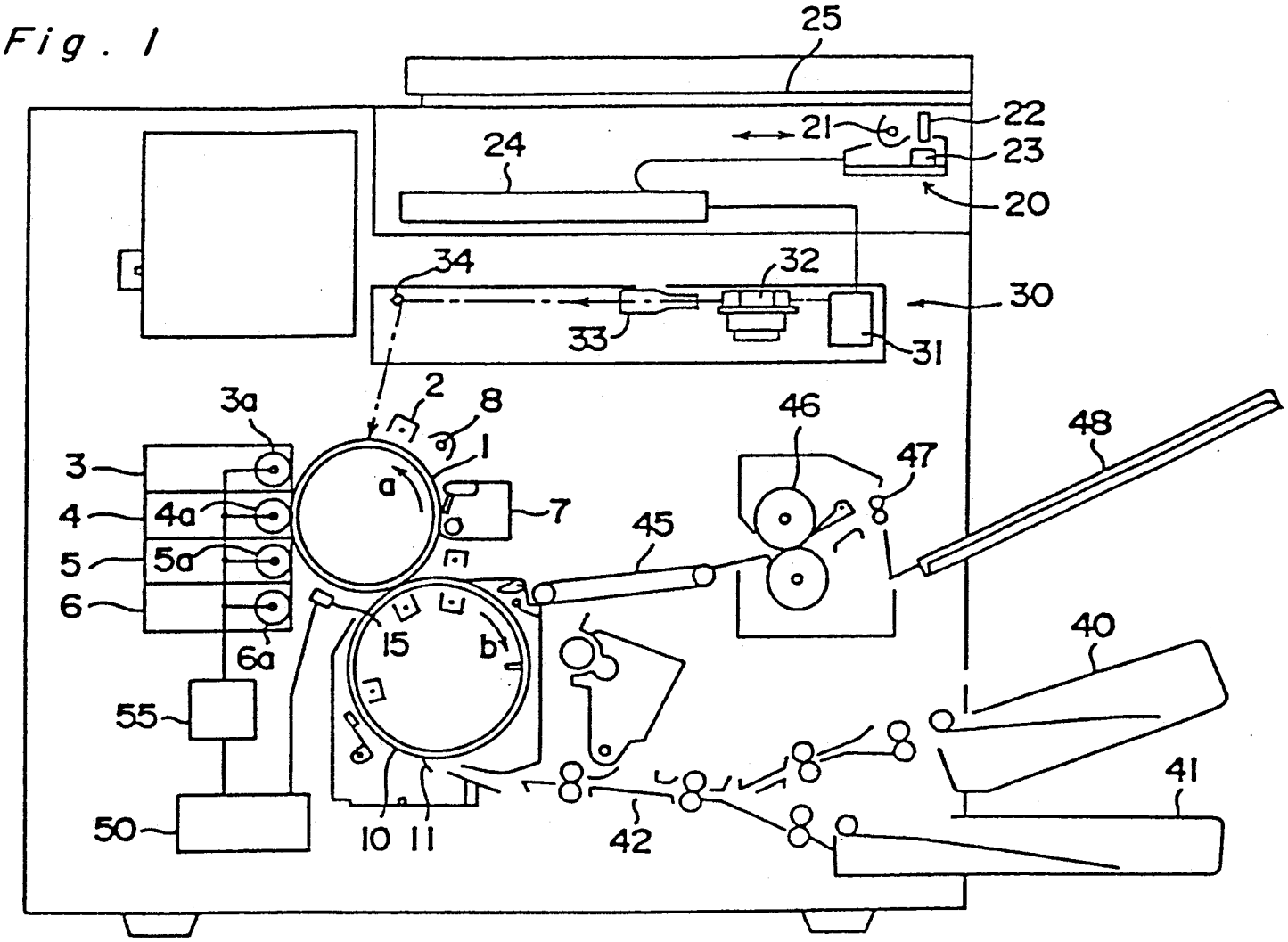
FIG. 1 is a schematic side sectional view of an electrophotographic full-color copying machine embodying the present invention.

In describing a preferred embodiment of the present invention which will now follow, reference is made solely for illustration purpose to an electrophotographic full-color copying machine shown in FIG. 1 of a design wherein an image-bearing document to be copied is adapted to be scanned by a color image reader to provide an imagewise optical signal to a laser optical system operable to line-scan a photoreceptor drum to form an electrostatic latent image corresponding to the image on the document.

Referring now to FIG. 1, the illustrated copying machine comprises a photoreceptor drum 1 supported for rotation in one direction shown by the arrow a, and has a plurality of processing stations defined externally around the photoreceptor 1. Those processing stations include a charging station at which an electrostatic charger 2 is disposed; an exposure station at which an electrostatic latent image is formed on the photoreceptor drum in a well-known manner; a developing station at which a magnetic brush developing device including four-staged developing units 3, 4, 5 and 6 positioned one above the other is disposed; a transfer station at which a transfer drum 10 is supported for rotation in one direction, shown by the arrow b, counter to the direction of rotation of the photoreceptor drum 1; a cleaning station at which a cleaning unit 7 is disposed for the removal of a residue toner remaining on the photoreceptor drum 1; and an erasing station at which an eraser lamp 8 is disposed for the removal of a residue electrostatic charge remaining on the photoreceptor drum 1 in readiness for the next succeeding cycle of copying operation.

The copying machine also comprises an image reader unit 20 supported beneath a transparent support platen 25 for reciprocating motion in opposite directions parallel to the support platen 25 and including an illuminator lamp 21, a lens array 22 and a CCD (charge-coupled device) line sensor 23, and a image processing circuit 24. An image-bearing document to be copied is adapted to be placed on the support platen 25 and, as the image reader unit 20 is driven leftwards as viewed in FIG. 1, an image of the document can be read by the CCD line sensor 23 which subsequently provides R (red), G (green) and B (blue) image-wise signals in three primary colors to the image processing circuit 24. These R, G and B imagewise signals are processed by the image processing circuit 24 so that they can be converted into Y (yellow), M (magenta), C (cyan) and Bk (black) imagewise signals in four complemental colors.

The laser optical system 30 comprises a laser unit 32 for generating laser beams corresponding respectively to the Y, M, C and Bk imagewise signals supplied from the image processing unit 24, a polygonal mirror unit 32 for oscillating the laser beams, an $f\theta$ lens 33 and a reflecting mirror 34 for directing the oscillating laser beams towards the photoreceptor drum 1 to form an electrostatic latent image for each color on an outer peripheral photosensitive surface of the photoreceptor drum 1.

The developing units 3 to 6 accommodate therein respective batches of yellow, magenta, cyan and black toner material and include respective developing sleeves 3*a*, 4*a*, 5*a* and 6*a* to which a biasing power unit 55 applies a bias voltage according to a command issued from a microcomputer 50. The developing device as a whole is supported for movement up and down so that any of the developing units 3 to 6 can successively assume, one at a time, a developing position C1 at which the developing unit 3 to 6 confronts the photosensitive surface of the photoreceptor drum 1 to develop the electrostatic latent images for the different colors into respective powder images in corresponding colors.

A paper supply unit includes first and second paper cassettes 40 and 41 accommodating therein respective batches of copying papers, the copying papers of one batch in the first paper cassette 40 being of a size which may be different from that of the copying papers of the other batch in the second paper cassette 41. The copying papers emerging from one of the first and second paper cassettes 40 and 41 are successively supplied through a transport passage 42, which may include a plurality of juxtaposed roller pairs and guide plates, towards the transfer drum 10 with a leading edge of the copying paper subsequently caught by a catch pawl 11 so that, as the transfer drum 10 is rotated in the direction shown by the arrow b in unison with the rotation of the photoreceptor drum 1, the copying paper can be turned around and transported by the transfer drum 10. The copying paper so turned around and transported by the transfer drum 10 subsequently arrives at the transfer station defined between the photoreceptor and transfer drums 1 and 10, at which the powder images of respective four colors carried by the photoreceptor drum 1 are transferred onto the copying paper.

A single cycle of copying operation to produce one full color copy of the image-bearing document consists of four successive shots of a process of charging, exposure, development and transfer, one shot for each color.

After the powder images of four colors have successively been transferred onto the single copying paper, the copying paper is separated from the transfer drum 10 and is then guided through a transport belt 45 towards a fixing unit 46 at which the powder images are permanently or substantially permanently fixed on the copying paper in a well known manner. The copying paper having the powder images so fixed thereon is subsequently ejected through an ejecting roller pair onto a copy receiving tray 48.

The copying machine to which the present invention is applicable is not always limited to the construction described hereinabove with reference to FIG. 1, but may be of any known construction. Therefore, further details of the copying machine will not be set forth herein for the sake of brevity.

In the copying machine of the construction described hereinbefore, in order to keep both the image density and the tone of the image constant throughout a repeated reproduction of full-color copies, the developing bias voltage applied from the biasing power unit 55 to any one of the developing sleeves 3*a*, 4*a*, 5*a* and 6*a* in the respective developing units 3, 4, 5 and 6 is controlled. According to the present invention, for optimizing the control of the bias voltage applied by the biasing power unit 55, the use has been made of a photoelectric toner sensor assembly 15 for measuring the quantity of a sample toner deposited on the photosensitive surface of the photoreceptor drum 1.

Figure 2A:
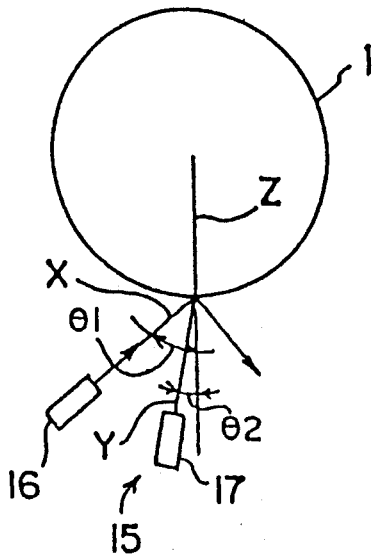
FIGS. 2(*a*) and 2(*b*) are schematic diagrams used to illustrate the position and operation of a photoelectric toner sensor assembly according to the present invention, as viewed in a direction conforming to an axis of rotation of a photoreceptor drum used in the copying machine of FIG. 1.
Figure 2B:
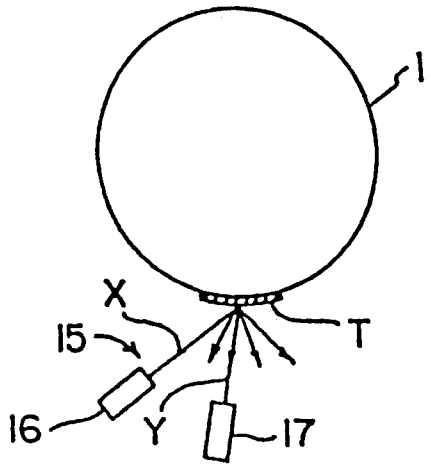
Figure 3A:
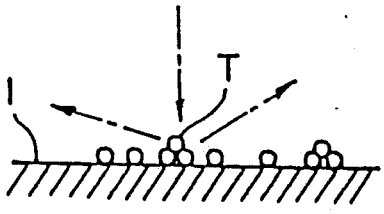
FIGS. 3(*a*) and 3(*b*) are schematic diagrams used to illustrate how rays of light from a light emitting diode are reflected by toner particles on the photoreceptor drum.
Figure 3B:
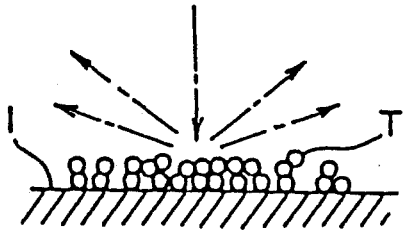

The photoelectric toner sensor assembly 15 employed in the practice of the present invention is best shown in FIGS. 2(*a*) and 2(*b*) and comprises a light emitting diode 16 for projecting rays of light towards the photoreceptor drum 1 and a photodiode 17 for detecting a portion of the projected light undergoing a diffuse reflection from the photosensitive surface of the photoreceptor drum 1. As discussed hereinbefore, the reflected rays of light contain a specular reflecting component which undergoes a specular reflection and a diffused reflecting component which undergoes a diffuse reflection. An increase in quantity of color toner deposit would not result in a substantial reduction of the amount of the specular reflecting component of the reflected rays of light and would rather result in a steep gradient of increase of the amount of the diffused reflecting component of the reflected rays of light (See FIGS. 3(*a*) and 3(*b*)), and therefore, a diffused light receiving system is employed in the practice of the present invention.

Figure 6:
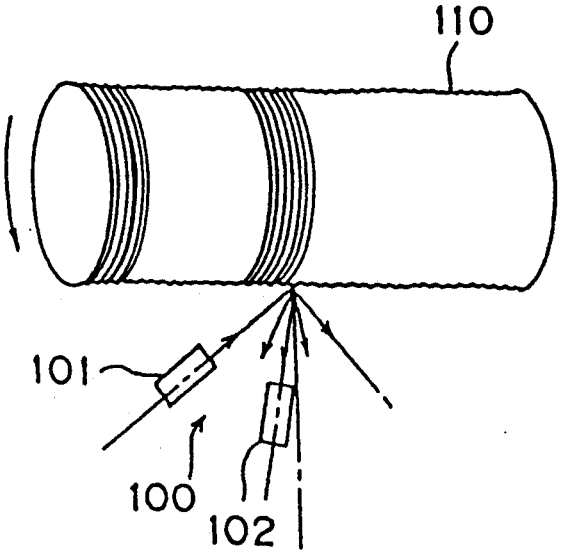
FIG. 6 is a schematic perspective view showing the contemplated photoelectric toner sensor assembly positioned relative to the photoreceptor drum.
Figure 7:
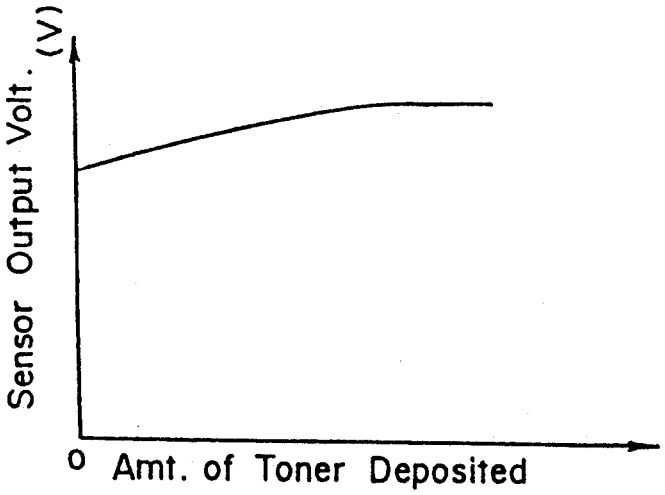
FIG. 7 is a graph showing a change in sensor output voltage relative to a change in amount of toner deposited on the photoreceptor drum, that is exhibited by the contemplated electric toner sensor assembly of FIG. 6.

Also, in the practice of the present invention, in order to avoid a formation of Moire fringes resulting from an interference of light which would occur when an image is delineated by the laser optical system 30 on the photosensitive surface of the photoreceptor drum 1, fringe suppressing grooves identical or similar to those shown in and described with reference to FIG. 6 are employed on an electroconductive outer peripheral surface of the photoreceptor drum 1 that is covered by a photosensitive layer. The fringe suppressing grooves may be formed by helically grinding the electroconductive outer peripheral surface of the photoreceptor drum 1 prior to the formation of the photosensitive layer thereon. The fringe suppressing grooves so formed has a maximum depth of 0.3 to 1.0 μm and are spaced from each other at a pitch of 0.1 to 0.2 mm, each of said fringe suppressing grooves having fine undulations defined thereon so as to be spaced a pitch of 2 to 30 μm from each other. So far in the illustrated embodiment, the fringe suppressing grooves extend slantwise with respect to the axis of rotation of the photoreceptor drum 1, having been formed by helically machining or grinding the drum 1

In order to minimize or substantially eliminate a reception by the photodiode 17 of a diffused light component of the rays of light reflected from the fringe suppressing grooves on the photoreceptor drum 1, the light emitting diode 16 and the photodiode 17 are so positioned that a common plane containing the optical axis X of the light emitting diode 16 and the optical axis Y of the photodiode 17 lies parallel to any one of the fringe suppressing grooves. Since the fringe suppressing grooves extend in a direction generally transverse to the axis of rotation of the photoreceptor drum 1, the common plane containing the optical axes X and Y of the light emitting diode 16 and the photodiode 17 lies also generally parallel to a plane containing the axis of rotation of the photoreceptor drum 1.

Figure 4:
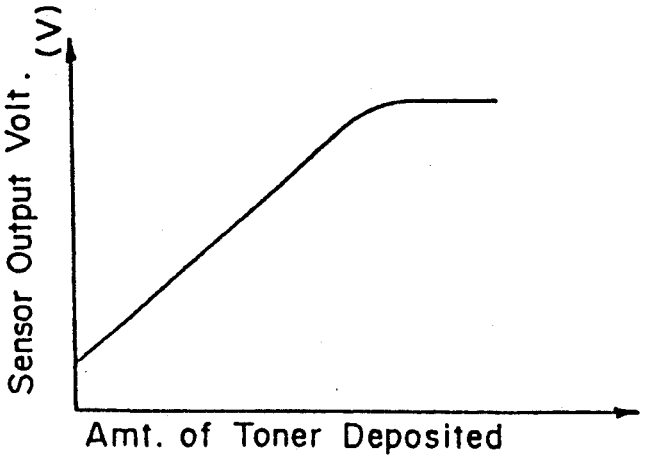
FIG. 4 is a graph showing a change in sensor output voltage relative to a change in amount of toner deposited on the photoreceptor drum.

With the photoelectric toner sensor assembly 16 arranged relative to the photoreceptor drum 1 in the manner described hereinabove, the rays of light projected from the light emitting diode 16 towards the photoreceptor drum 1 can be received by the photodiode 17 without having been diffused by the fringe suppressing grooves and, therefore, as shown in the graph of FIG. 4, the sensor output voltage can be substantially zeroed when the quantity of the toner deposit is zero, that is, when the photosensitive surface of the photoreceptor drum 1 is exposed bare without being covered by the toner deposit. Therefore, it is possible to improve the signal-to-noise (S/N) ratio during the measurement of the toner quantity, making it possible to increase a change in sensor output voltage. This feature substantially minimizes an error occurring during the measurement of the quantity of the toner deposit so that an accurate control of the bias voltage to be applied to any one of the developing sleeves 3*a*, 4*a*, 5*a* and 6*a* in the developing device is possible thereby to accomplish a favorable image stabilizing control.

It is to be noted that, in the practice of the present invention, the light emitting diode 16 and the photodiode 17 are so positioned relative to the photoreceptor drum 1 that the angle $\theta 1$ defined between the optical axis X of the light emitting diode 16 and a line Z normal to the photoreceptor drum 1 and the angle $\theta 2$ defined between the optical axis Y of the photodiode 17 and the same line Z normal to the photoreceptor drum 1 may be within the range of 40 to 70 degrees and within the range of 0 to 10 degrees, respectively. A selection of these specific angles $\theta 1$ and $\theta 2$ is particularly effective to minimize the reception by the photodiode 17 of those rays of light which have been reflected and diffused from the photosensitive surface of the photoreceptor drum 1.

It is also to be noted that, with respect to the interval between the light emitting diode 16 and the photodiode 17 and the distance of separation of any one of the light emitting diode 16 and the photodiode 17 from the photosensitive surface of the photoreceptor drum 1, they may be suitably chosen provided that no light from the light emitting diode 16 will enter the photodiode 17 directly.

To accomplish the image stabilizing control with the use of an output signal from the photoelectric toner sensor assembly 15 that is indicative of the quantity of the toner deposit on the photoreceptor drum 1, different methods can be used. For example, one method comprises the steps of forming a sample toner image of half-tone under a predetermined condition; measuring, with the use of the photoelectric toner sensor assembly 15, the amount of light reflected under a diffuse reflection from the sample toner image and, also, the amount of light reflected under a diffuse reflection from the photosensitive surface of the photoreceptor drum; and comparing respective outputs from the photoelectric toner sensor assembly 15 indicative of such amounts of light to determine the quantity of the toner deposit forming the sample toner image.

Another method comprises the steps of forming a sample toner image of a kind which would cause a sensor output indicative of the amount of light reflected under a diffuse reflection to be of a saturated level; comparing the measurement of this amount of light reflected under a diffuse reflection with either of the amount of light reflected under a diffuse reflection from the sample toner image and the amount of light reflected under a diffuse reflection from the photosensitive surface of the photoreceptor drum, thereby to determine accurately the quantity of the toner deposit forming the sample toner image of half-tone.

Figure 5:
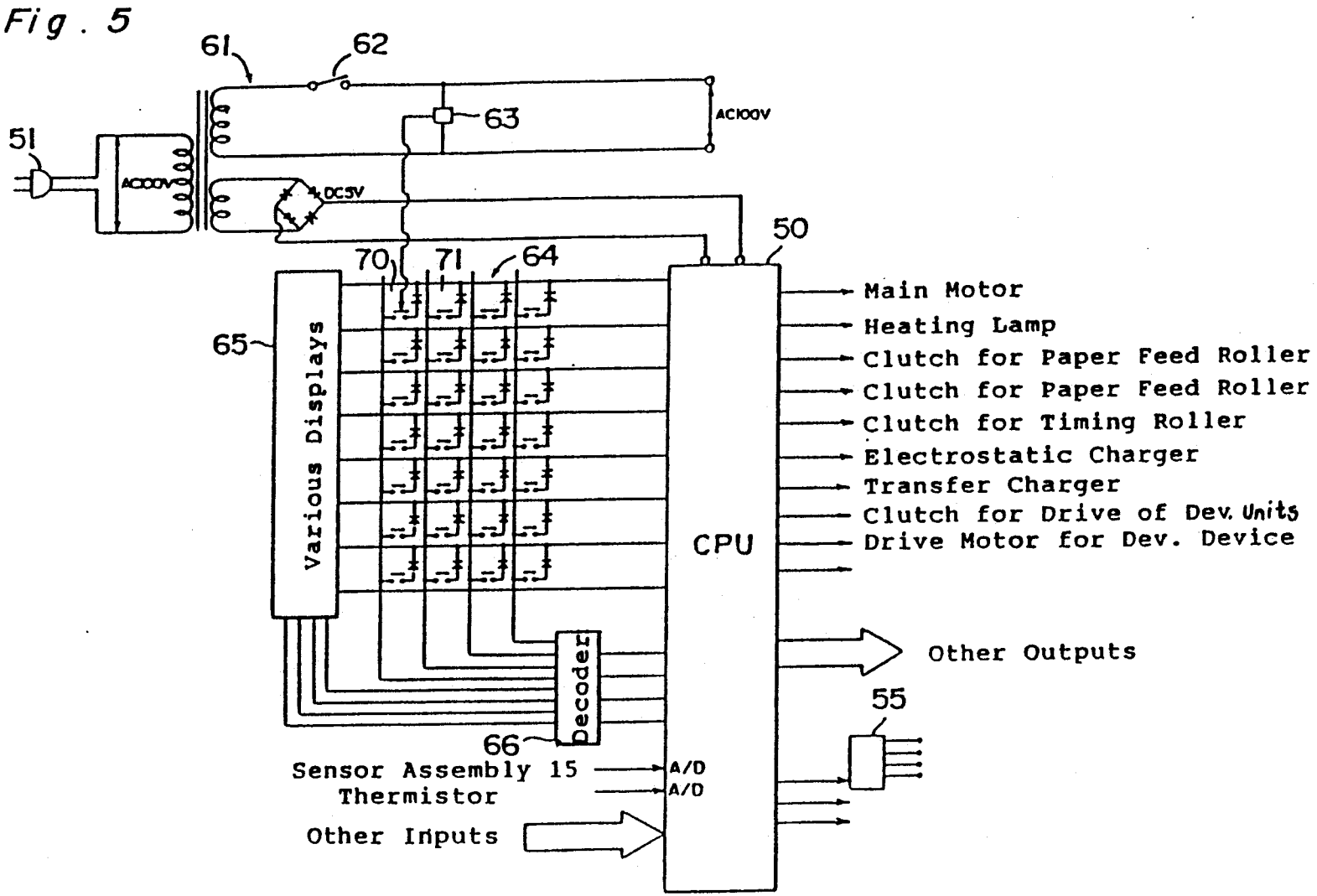
FIG. 5 is a block diagram showing an electric control system used in the copying machine.

A control circuit employed in the copying machine in combination with the foregoing photoelectric toner sensor assembly 15 is schematically shown in FIG. 5, reference to which will now be made.

Referring now to FIG. 5, the microcomputer 50 has an analog-to-digital converter built therein and, when a plug 51 is inserted in a AC 100 v commercial power outlet, the microcomputer 50 is energized by a DC 5 v power supplied from a power supply 61, regardless of whether or not a power source switch 62 is turned on. When the power source switch 62 is subsequently turned on, main switches 70 included in a switch matrix 64 are switched on by a relay assembly 63. The switch matrix 64 includes various input means including, for example, a COPY switch 71 and various display units 65. Input signals to the various switches of the switch matrix 64 are supplied through a decoder 66 to the microcomputer 50 on a time-sharing basis. The microcomputer 50 has a plurality of analog input ports to which respective signals from the photoelectric toner sensor assembly 15, a thermistor used in the fixing unit and others are supplied. This microcomputer 50 also has a plurality of output ports from which control signals to be supplied to the biasing power unit 55 and drive signals to be supplied to a main motor and various clutches used in the copying machine are outputted.

While the present invention has fully been described in connection with the preferred embodiment thereof with reference to the accompanying drawings, it is to be noted that various changes and modifications are apparent to those skilled in the art. By way of example, the image forming apparatus to which the present invention pertains may not be always limited to that described above, but may be varied in numerous ways. By way of example, the structural details of the copying machine may be of any desired design. Similarly, the specific manner of how the quantity of the toner deposit is detected in the photoelectric toner sensor assembly 15 may be suitably chosen.

Also, for the image stabilizing control, one or a combination of the methods may be employed in which the bias voltage to be applied to one or more developing sleeves is controlled; the initial surface potential of the photoreceptor drum based on an output from the electrostatic charger 2 is controlled; the potential of an image area based on the intensity of the laser beam is controlled; the amount of toner to be supplied is controlled.

Such changes and modifications are to be understood as included within the scope of the present invention as defined by the appended claims unless they depart therefrom.

What is claimed is:

1. An image forming apparatus for forming a visible image on a sheet material, said apparatus comprising:

a photoreceptor medium including a substrate and a photosensitive layer formed on the substrate, said substrate having a regularly developed pattern of grooves formed thereon;

means for measuring the amount of rays of light reflected from the photoreceptor medium and undergoing diffuse reflection therefrom, said measuring means comprising a light emitting element and a light receiving element, each of said elements having an optical axis, said light emitting and receiving elements being so positioned that a common plane containing the respective optical axes lies substantially parallel to any one of the grooves on the substrate; and means for controlling said apparatus based on the amount of rays of light measured by said measuring means.

2. The image forming apparatus as claimed in claim 1, wherein the light emitting element and the light receiving element are so positioned relative to the photoreceptor medium that an angle defined between the optical axis of the light emitting element and a line normal to the photoreceptor medium and an angle defined between the optical axis of the light receiving element and a line normal to the photoreceptor medium are within the range of 40 to 70 degrees and within the range of 0 to 10 degrees, respectively.

3. The image forming apparatus as claimed in claim 1, wherein said grooves on the substrate extend helically and are spaced from each other at a pitch of 0.1 to 0.2 mm, each of said grooves having a maximum depth of 0.3 to 1.0 μm.

4. An image forming apparatus which comprises:

a photoreceptor medium including a substrate and a photosensitive layer formed on the substrate, said substrate having a regularly developed pattern of grooves formed thereon;

means for electrostatically charging the photoreceptor medium;

a laser optical system for forming an electrostatic latent image on the photoreceptor medium;

a developing means for developing the electrostatic latent image into a toner image, said developing means including means for applying a developing bias voltage;

means for varying a voltage to be applied by the bias voltage applying means;

means for projecting a beam of light onto the photoreceptor medium so as to reflect therefrom and for measuring a portion of the light beam undergoing a diffuse reflection from the photoreceptor medium, said projecting and measuring means including a light emitting element and a light receiving element, each of said elements having an optical axis, said light emitting and receiving elements being so positioned that a common plane containing the respective optical axes lie substantially parallel to any one of the grooves on the substrate; and a control means for varying the applied voltage according to a result of measurement carried out by said projecting and measuring means.

5. The image forming apparatus as claimed in claim 4, wherein the light emitting element and the light receiving element are so positioned relative to the photoreceptor medium that an angle defined between the optical axis of the light emitting element and a line normal to the photoreceptor medium and an angle defined between the optical axis of the light receiving element and the line normal to the photoreceptor medium are within the range of 40 to 70 degrees and within the range of 0 to 10 degrees, respectively.

6. The image forming apparatus as claimed in claim 4, wherein said grooves on the substrate extend slantwise and are spaced from each other at a pitch of 0.1 to 0.2 mm, each of said grooves having a maximum depth of 0.3 to 1.0 μm.

7. An image forming apparatus for forming a visible image on a sheet material, said apparatus comprising:

a photoreceptor medium including a substrate and a photosensitive layer formed on the substrate, said substrate having a regularly-developed pattern of grooves formed thereon;

means for forming an electrostatic latent image on the photoreceptor medium, developing the electrostatic latent image into a visible image and transferring the visible image on a sheet material;

means for measuring the amount of rays of light reflected from the photoreceptor medium and undergoing diffuse reflection therefrom, said measuring means including a light emitting element and a light receiving element, each of said elements having an optical axis, said light emitting and receiving elements being so positioned that a common plane containing the respective optical axes lies substantially parallel to any one of the grooves on the substrate; and means for controlling said image forming means according to the amount of rays measured by said measuring means.

* * * * *